US005887458A

United States Patent [19]

Bae

[11] Patent Number: 5,887,458

[45] Date of Patent: Mar. 30, 1999

[54] DRIVING SYSTEM FOR WASHING MACHINE

[75] Inventor: Sang-Chul Bae, Seoul, Rep. of Korea

[73] Assignee: Samsung Electronics Co., Ltd., Suwon, Rep. of Korea

[21] Appl. No.: 921,372

[22] Filed: Aug. 29, 1997

[30] Foreign Application Priority Data

May 9, 1997 [KR] Rep. of Korea ..... 1997 18035

[51] Int. Cl.[6] ..... D06F 23/04; D06F 37/40

[52] U.S. Cl. ..... 68/23.7

[58] Field of Search ..... 68/23.6, 23.7

[56] References Cited

U.S. PATENT DOCUMENTS 2,346,158 4/1944 Dyer ..... 68/23.6 X 3,216,227 11/1965 Alger et al. ..... 68/23.7

FOREIGN PATENT DOCUMENTS 237596 9/1990 Japan ..... 68/23.7

*Primary Examiner*—Philip R. Coe

*Attorney, Agent, or Firm*—Larson & Taylor

[57] ABSTRACT

A driving system for a washing machine having a washing shaft connected with an agitator in the center of a washing tub to stir laundry in washing mode, and an extracting shaft positioned outside the washing shaft and connected with an extracting tub which rotates at high speeds in extracting mode, further includes a power generator for generating power to rotate the washing shaft and the extracting shaft, a decelerator installed under the power generator to reduce the number of rotation transmitted from the power generator, and a power-switching device for de-energizing the extracting shaft in washing mode and for energizing the extracting shaft in extracting mode.

9 Claims, 5 Drawing Sheets

DRIVING SYSTEM FOR WASHING MACHINE

BACKGROUND OF THE INVENTION

1. Field of the Invention

The present invention relates to a driving system for a washing machine. More particularly, it relates to a driving system for a washing machine having a decelerating device mounted under a motor for reducing the rotation speed of the motor so as to decrease the bulk and weight of the washing machine whereby the washing task can be converted into the extracting task and vice versa by means of a single lever.

2. Discussion of Related Art

The conventional art will be described with reference to the attached drawings.

A conventional washing machine, as shown in FIG. 1, includes a housing 1, a washing tub 2 held in the housing 1, a driving means 3 installed below the washing tub 2, and a power transmission means 5 connected with the driving means 3 via a driving belt 4 to be driven by the driving means 3.

An extracting tub 6 is installed in the washing tub 2 and positioned in front of the power transmission means 5 to spin by the transmitted power. An agitator 7 is installed on the bottom of the extracting tub 6 so as to agitate and wash garments by applying physical force thereto, simultaneously with rotating right and left on receipt of power from the power transmission means 5, to make the water turbulent.

A water supply means 8 is installed in the extracting tub 6 at the rear of the housing 1 to furnish water to the extracting tub 6, and a drain means 9 is installed under one end of the extracting tub 6 to discharge the water to the outside. Under the water-supply means 8, is installed a detergent dissolving means 10 to dissolve a detergent with the water from the water supply means 8 and provide it to the washing tub 2 and the extracting tub 6.

As shown in FIG. 2, the agitator 7 includes a pulsator 7*a* which is coupled with the power transmission means 5 to rotate reversibly right and left on the bottom of the extracting tub 6 for making water turbulent, thus stirring and washing the laundry; a vertical fan 7*b* which is integrally attached to the middle of the pulsator 7*a* for rotating with the pulsator 7*a* making a right-and-left reversion and for forming water current jetting upward in order to prevent the laundry from being twisted and tangled; and a plurality of wings 7*d* which are formed to protrude radially around a shaft 7*c* of the pulsator 7*a*, spaced a given distance away from each other.

The power transmission means 5 includes a pulley 11 operating together via the driving belt 4 by the driving power of the driving means 3; a driving shaft 12 rotatably coupled with the pulley 11; a coupling 13 engaged with the driving shaft 12, a lower connector 14 rotatably installed at an inner circumference of an upper part of the driving shaft 12 via a pair of upper and lower bushings 15, and an upper connector 16 rotatably installed above the lower connector 14, thereby rotating integrally.

A brake band 17 is installed at an outer circumference of the upper connector 16 so that binding force holding the upper connector 16 is released when a brake lever is operated.

A driven shaft coupling 18, on which the extracting tub 6 is installed, is coupled to the upper portion of the upper connector 16 by a serration method, and a driven shaft 20, to which the agitator 7 is coupled via two upper and lower bushings 19, is rotatably installed at the inner circumference of the driven shaft coupling 18 via two upper and lower bushings 19.

The driving shaft 12 is engaged with a linear gear 21 at its upper end and the linear gear 21 is engaged with a plurality of planetary gears 22 at its circumference, so that the planetary gears 22 can freely decelerate while rotating through a shaft 25 which is coupled between an upper carrier 23 and a lower carrier 24 respectively installed on upper and lower parts of the driven shaft 20.

The planetary gears 22 rotate engaged with an internal gear 26 that is formed on an inner circumference of the upper connector 16. On the outer circumference of the lower part of the lower connector 14, are inserted ball bearings 27 into the bottom of a lower case 28 so that the lower connector 14 may rotate easily by means of the ball bearings 27. Supporting members 30 are installed on the ball bearings 27 via the bushing 15 and a clutch bearing 29 and coupled with a lower part of the lower case 28 by a fixing means 31. A clutch spring 32 is installed between end parts of the lower connector 14 and the driving shaft coupling 13 to control the washing and extracting tasks, and surrounded with a clutch holder 33 through the whole surface of the clutch spring 32. The clutch spring 32 has an upper end which is engaged with the lower connector 14, and a lower end which is fixedly connected with the clutch holer 33 surrounding the outer surface of the clutch spring 32. A sleeve member 35 of saw-toothed shape is installed at an outer circumference of the clutch holder 33 via a brake ring 34.

A brake lever 36 is installed at one side of the lower case 28, and a connecting lever 37 is installed under the brake lever 36, so that the sleeve member 35 and the brake ring 34 compress the clutch spring 32 when the brake lever 36 is driven. A clutch lever 38 is installed at one side of the brake lever 36 to receive the power of a drain motor (not shown) for operating the brake lever 36 and the connecting lever 37. Reference numeral 39 denotes an upper case.

In such a conventional washing machine, however, the construction is complicated and causes in an increase in noise or vibration during operation since the driving means is off-centered from the driving shaft.

SUMMARY OF THE INVENTION

Accordingly, the present invention is directed to a driving system for a washing machine that substantially obviates one or more of the problems due to limitations and disadvantages of the related art.

It is an object of the present invention to provide a driving system for a washing machine that can improve assembly by simplifying its structure and minimize noise or vibration by mounting the driving means on the center line of the driving shaft.

In order to obtain the aforementioned objectives of the present invention, the inventive driving system for a washing machine, having a washing shaft connected with an agitator in the center of a washing tub to stir laundry in washing mode, and an extracting shaft positioned outside the washing shaft and connected with an extracting tub which rotates at high speeds in extracting mode, includes: a power generator for generating power to rotate the washing shaft and the extracting shaft, a decelerator installed under the power generator to reduce the number of rotation transmitted from the power generator, and a power-switching device for de-energizing the extracting shaft in washing mode and for energizing the extracting shaft in extracting mode.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

DETAILED DESCRIPTION OF PREFERRED EMBODIMENT

Reference will now be made in detail to the preferred embodiments of the present invention, examples of which are illustrated in the accompanying drawings.

Figure 1:
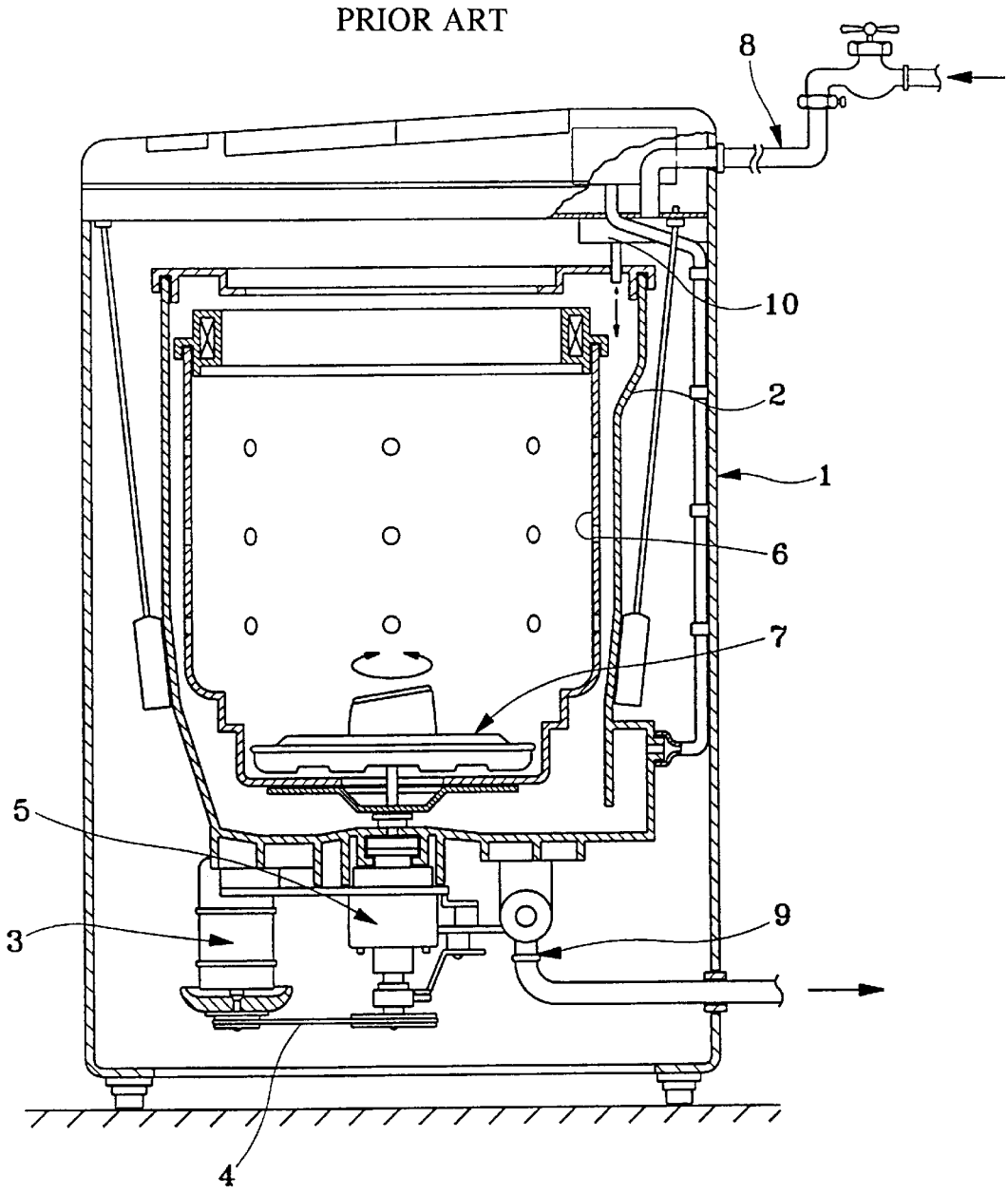
FIG. 1 PRIOR ART
FIG. 1 is a longitudinal-sectional view of a conventional washing machine.
Figure 2:
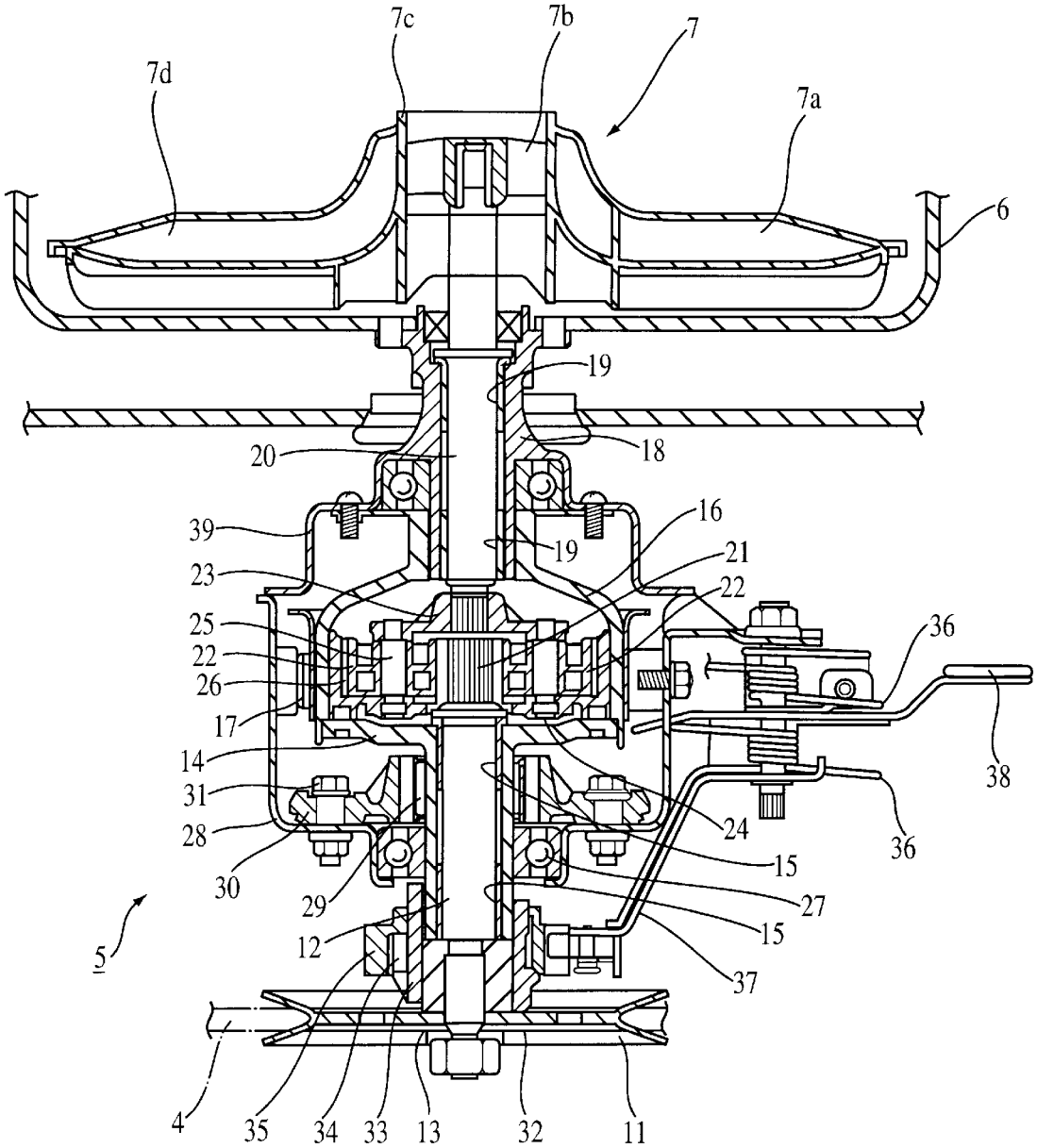
FIG. 2 PRIOR ART
FIG. 2 is a longitudinal-sectional view of a driving means of the conventional washing machine.
Figure 3:
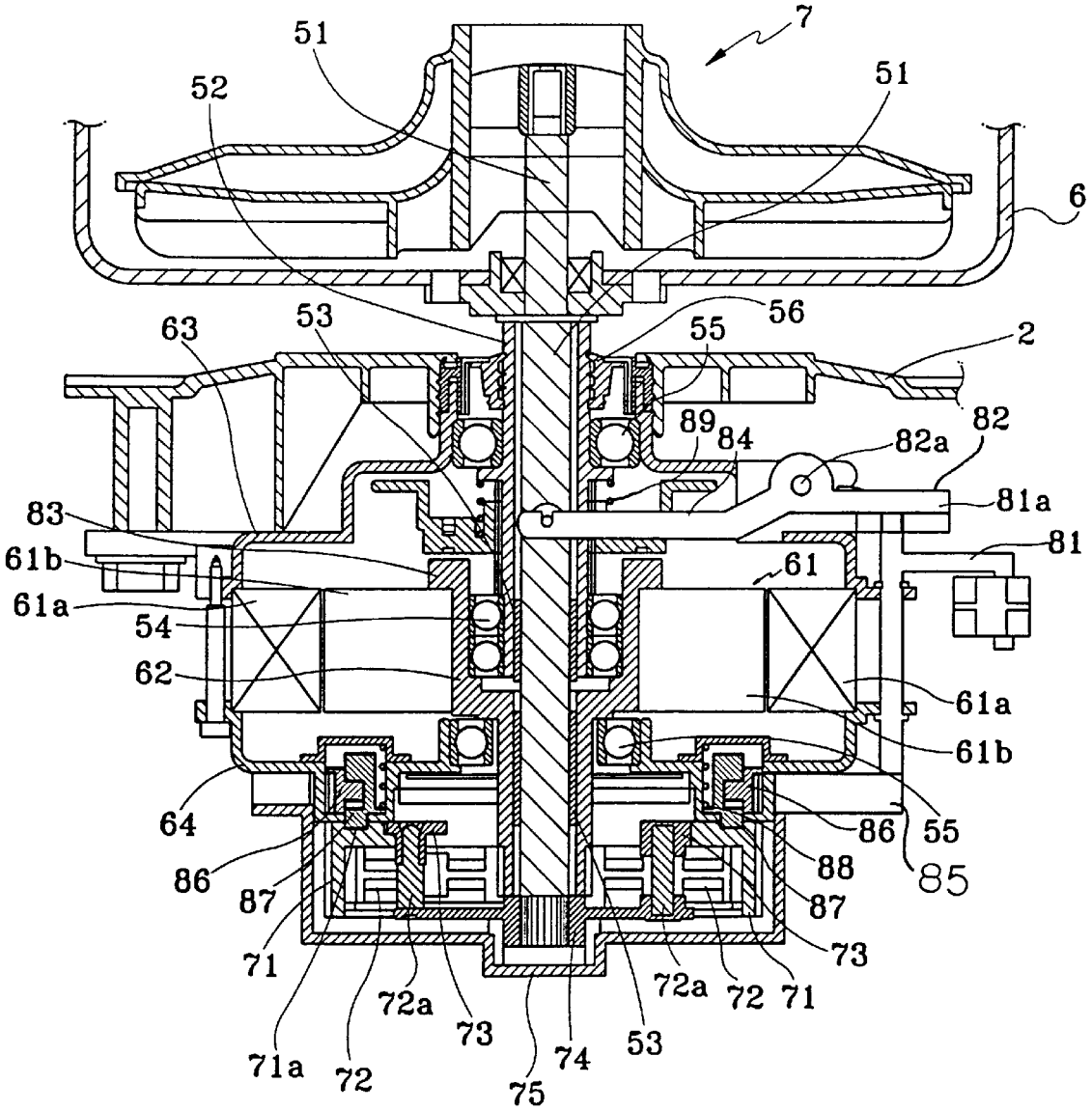
FIG. 3 is a longitudinal-sectional view of a washing machine in washing mode.
Figure 4:
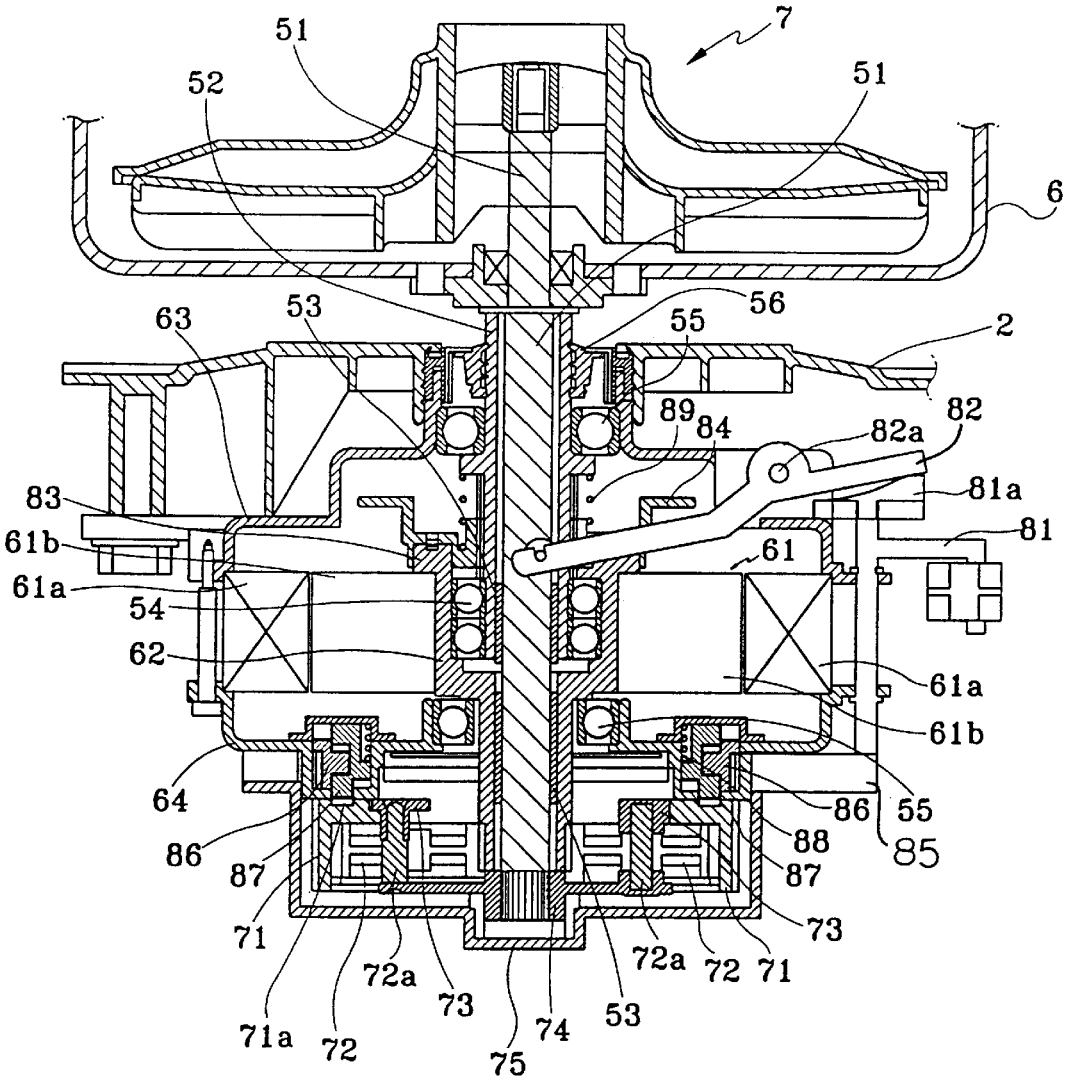
FIG. 4 is a longitudinal-sectional view of a washing machine in extracting mode.
Figure 5:
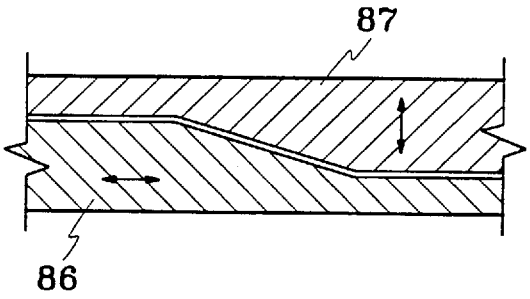
FIG. 5 is a sectional view of principal parts showing first and second cams which are coupled each other.

Referring to FIG. 3 to FIG. 5, a washing tub 2 has a washing shaft 51 formed on the middle to be connected with an agitator 7 which stirs garments in washing mode, an extracting shaft 52 connected with an extracting tub 6 which is positioned outside of the washing tub 2 and rotates at high speeds in extracting mode, and a metal bearing 53 installed between the washing shaft 51 and the extracting shaft 52 for separate rotation of the washing shaft 51 and the extracting shaft 52.

A driving system for a washing machine in accordance with the present invention includes a power generator for generating power to rotate the washing shaft 51 and the extracting shaft 52, a decelerator installed under the power generator for reducing rotation speed transmitted from the power generator, and a power-switching device to switch power supply between the washing shaft 51 and the extracting shaft 52 according to washing mode and extracting mode.

The power generator includes a motor 61 having a stator 61*a* which creates magnetic fields with applied power and a rotator 61*b* which rotates by the magnetic fields formed by the stator 61*a*, a motor shaft 62 inserted in the stator 61*b* for integrally rotating with the rotator 61*b*, and upper and lower housings 63 and 64 for covering the motor 61 and the motor shaft 62, respectively.

The decelerator includes an internal gear 71 having teeth formed on its inner circumference, a plurality of planetary gears 72 positioned in the internal gear 71 and engaged with the teeth of the internal gear 71 to rotate together with the internal gear 71, upper and lower carriers 73 and 74 respectively installed at upper and lower parts of the planetary gears 72 for connecting a central shaft 72*a* of the plurality of the planetary gears 72 to rotate the planetary gears 72 simultaneously, and a cover 75 for covering outside lower parts of the above respective components. The lower carrier 74 is coupled at its center with a lower part of the washing shaft 51 by a serration method.

The power-switching device includes a cam lever 81 rotatably coupled on either side of upper and lower housings 63 and 64 and closely connected with a cam 81*a* at its upper part, a first clutch lever 82 pivoting with relation to a hinge 82*a* according to the rotation of the cam 81*a*, and a second clutch lever 84 connected with the first clutch lever 82 and the outer circumference of the extracting shaft 52 by the serration method so as to control the power supply by being engaged with the first clutch 83 which is closely connected with the upper surface of the motor shaft 62 while moving vertically.

The power-switching device also includes a gear lever 85 perpendicularly connected to the cam lever 81 thereunder and rotating together with the cam lever 81, a first cam 86 and a second cam 87 loosely engaged with each other so that the first cam 86 rotates together with the gear lever 85 and the second cam 87 moves vertically by a stair-like portion between the first cam 86 and the second cam 87, and coil springs 88 and 89 respectively installed on an inner circumference of each of the second cam 87 and the second clutch 84 to be compressed and expanded according to the rotation of the cam lever 81 at the time of switching the washing mode to the extracting mode.

In this case, the rotation of the motor shaft 62 can not be directly transmitted due to ball bearing 54 and metal bearings 53, wherein the ball bearings 54 are positioned between an inner circumference of an upper part of the motor shaft 62 and an outer circumference of the extracting shaft 52 and the metal bearings 53 is positioned between the motor shaft 62 is the inner circumference of the lower part of the motor shaft 62 and the outer circumference of the washing shaft 51. Further, the motor shaft 62 is engaged with a plurality of planetary gears 72 to transmit its rotation force to the planetary gears 72.

The lower carrier 74 is coupled with the lower end part of the washing shaft 51 at its center to rotate with the washing shaft 54 and the internal gear 71 has a groove 71*a* on its upper surface so that the rotation of the internal gear 71 is restrained with the second cam 87's moving downward.

The following description relates to the operation of the driving system for the washing machine according to the present invention.

In washing mode, as shown in FIG. 3, if a certain washing condition is selected and the power is applied to the washing machine, a proper amount of water is supplied to the extracting tub 6 and magnetic fields are created around the stator 61*a* of the motor 61 which is installed at the lower part of the center of the washing tub 2. The rotator 61*b* rotates by the magnetic fields created around the stator 61*a*, and accordingly the motor shaft 62, provided to the center of the rotator 61*b*, rotates at high speeds. At the same time, the motor shaft 62 rotates a plurality of planetary gears 72 which are engaged under the lower part of the motor shaft 62 and the lower carrier 74 which is connected to the respective center shafts 72*a* of a plurality of planetary gears 72, so that the washing shaft 51 which is coupled with the center of the lower carrier 74 by the serration method comes to rotate.

In the above case, the clutch lever 82 pivots with relation to the hinge 82*a* in response to the rotation of the cam 81*a* by the operation of the cam lever 81, and the second clutch 84 which is connected to one end of the clutch lever 82 moves upwardly. The first cam 86 engaged with the gear lever 85 which is located under the cam lever 81 to rotate together with the cam lever 81 radially rotates by a predetermined length to slidably contact the stair-like portion of the first cam 86. The first cam 86 then moves downwardly by the coil spring 88 which is compressed in the second cam 87, thus being inserted into the groove 71*a* of the internal gear 71.

Since the internal gear 71 does not rotate, the planetary gears 72 and the lower carrier 74 reduce the rotation speed and the washing shaft 51 reverses right and left at the reduced rotation speed to carry out the washing task.

If the washing task is finished, the water is drained and the extracting task is carried after completion of rinsing.

Once the extracting task starts, as shown in FIG. 4 and FIG. 5, the cam 81*a* of the cam lever 81 rotates and the clutch lever 82 pivots with relation to the hinge 82*a*. Then, the second clutch 84 connected at one side of the clutch lever 82 moves downwardly and the first cam 86 that is engaged with the gear lever 85, located under the cam lever 81 to rotate together with the cam lever 81, radially rotates by a predetermined length to slidably contact the stair-like portion of the first cam 86. Then, the first cam 86 moves upwardly by the coil spring 88 which is compressed in the second cam 87 to be released from the groove 71*a* of the internal gear 71, thereby its rotation is restrained.

At the same time, the motor shaft 62 which rotates together with the rotator 61*b* of the motor 61 makes a plurality of the planetary gears 72, engaged under the lower part of the motor shaft 62, rotate, and accordingly the lower carrier 74 which is connected to respective center shafts 72*a* of a plurality of the planetary gears 72 rotates, so that the washing shaft 51 which is coupled with the center of the lower carrier 74 by the serration method comes to rotate.

As described above, since the internal gear 71 rotates, the rotation speed is not decreased by the planetary gears 72 and the lower carrier 74 and the first clutch 83 and the second clutch 84 which are formed integrally at the upper part of the motor shaft 62 become engaged with each other, so that the extracting shaft 51, coupled with the inner circumference of the second clutch 84 by the serration method, rotates at high speeds to carry the washing task.

The driving system for a washing machine of the present invention, the power generator is vertically connected under the lower part of the washing tub and the decelerator is installed under the power generator, which facilitates the assemblage and offers a structure simplification. In addition, the present invention ensures a decrease in noise or vibration by connecting the power generator directly to the center line of the bottom of the washing tub.

It will be apparent to those skilled in the art that various modifications and variations can be made in the driving system for a washing machine of the present invention without departing from the spirit or scope of the invention. Thus, it is intended that the present invention cover the modifications and variations of this invention provided they come within the scope of the appended claims and their equivalents.

What is claimed is:

1. A driving system for a washing machine, including a washing shaft connected with an agitator in the center of a washing tub to stir laundry in a washing mode, and an extracting shaft positioned outside of the washing shaft and connected with an extracting tub which rotates at high speeds in an extracting mode, said driving system comprising:

a power-generating means for generating power to rotate said washing shaft and said extracting shaft;

a decelerating means installed under said power-generating means to reduce the number of rotations transmitted from said power-generating means; and a power-switching means for de-energizing said extracting shaft in the washing mode and for energizing said extracting shaft in the extracting mode, wherein said power-switching means includes a cam lever rotatable coupled on either side of upper and lower housings of said power generating means and closely connected with a cam at its upper part, a first clutch lever pivoting with relation to a hinge by rotation of the cam, a second clutch lever connected with said first clutch lever and an outer circumference of the extracting shaft by a serration so as to control the power by being engaged with said first clutch which is closely connected with an upper surface of a motor shaft while moving vertically, a gear lever perpendicularly connected to said cam lever thereunder and rotating together with said cam lever, a first cam and a second cam loosely engaged with each other so that said first cam rotates together with said gear lever and said second cam moves vertically by a stair-like portion formed in the loose engagement between said first cam and said second cam, and coil springs respectively installed on an inner circumference of said second cam and said second clutch lever to be compressed and expanded by rotation of said cam lever when the washing mode is switched to the extracting mode.

2. A driving system as set forth in claim 1, wherein said power-generating means includes:

a motor having a stator which creates magnetic fields by the applied power and a rotator which rotates by the magnetic fields created by said stator, and a motor shaft inserted into said stator for integrally rotating with said rotator; and wherein said upper and lower housings respectively cover said motor and said motor shaft.

3. A driving system set forth in claim 2, wherein said motor shaft includes ball bearings positioned between an inner circumference of the upper part of said motor shaft and an outer circumference of said extracting shaft, and metal bearings positioned between an inner circumference of the lower part of said motor shaft and an outer circumference of said washing shaft, so that the rotation of said motor shaft is not directly transmitted.

4. A driving system set forth in claim 3, wherein said motor shaft is engaged with a plurality of the planetary gears to transmit its rotation force to said plurality of planetary gears.

5. A driving system set forth in claim 2, wherein said motor shaft is engaged with a plurality of the planetary gears to transmit its rotation force to said plurality of planetary gears.

6. A driving system set forth in claim 1, wherein said decelerating means includes:

an internal gear having teeth formed on its inner circumference;

a plurality of planetary gears positioned in said internal gear and engaged with said teeth of said internal gear to rotate together with said internal gear;

upper and lower carriers respectively installed at upper and lower parts of said plurality of planetary gears and connected to central shafts of said plurality of planetary gears for rotating said plurality of planetary gears simultaneously; and a cover for covering outside lower parts of respective components.

7. A driving system set forth in claim 6, wherein said lower carrier is coupled at a center thereof with a lower part of said washing shaft to rotate together with said washing shaft.

8. A driving system set forth in claim 6, wherein said internal gear has a groove on its upper surface so that the rotation of said internal gear is limited by the second cam moving downward into said groove.

9. A driving system set forth in claim 1, wherein said internal gear has a groove on its upper surface so that the rotation of said internal gear is limited by the second cam moving downward into said groove.

* * * * *